US007782148B2

(12) United States Patent
Michalewicz

(10) Patent No.: US 7,782,148 B2
(45) Date of Patent: Aug. 24, 2010

(54) PARTICLE OPTICS AND WAVEGUIDE APPARATUS

(75) Inventor: Marek Tadeusz Michalewicz, Victoria (AU)

(73) Assignee: Quantum Precision Instruments Asia PTE LTD, Singapore (SG)

( * ) Notice: Subject to any disclaimer, the term of this patent is extended or adjusted under 35 U.S.C. 154(b) by 686 days.

(21) Appl. No.: 11/662,523

(22) PCT Filed: Sep. 12, 2005

(86) PCT No.: PCT/AU2005/001388

§ 371 (c)(1),
(2), (4) Date: Mar. 12, 2007

(87) PCT Pub. No.: WO2006/029450

PCT Pub. Date: Mar. 23, 2006

(65) Prior Publication Data

US 2008/0088381 A1 Apr. 17, 2008

(30) Foreign Application Priority Data

Sep. 14, 2004 (AU) ..... 2004905280

(51) Int. Cl.
*G21K 1/10* (2006.01)
*G21K 1/06* (2006.01)

(52) U.S. Cl. ..... 331/81; 716/9; 365/151

(58) Field of Classification Search ..... 331/81; 716/9; 365/151; 359/245
See application file for complete search history.

(56) References Cited

U.S. PATENT DOCUMENTS 5,212,583 A 5/1993 Vali et al.
6,128,214 A 10/2000 Kuekes et al.
6,157,101 A * 12/2000 Ullakko ..... 310/26
6,256,767 B1 7/2001 Kuekes et al.

FOREIGN PATENT DOCUMENTS

WO WO 00/14476 3/2000

OTHER PUBLICATIONS

R. Folman et al. "Microscopic Atom Optics: From Wires to An Atom Chip", Advances in Atomic, Molecular and Optical Physics, (2002), pp. 263-356, vol. 48.

(Continued)

*Primary Examiner*—Joseph Chang
(74) *Attorney, Agent, or Firm*—Foley & Lardner LLP

(57) ABSTRACT

An apparatus for manipulating or modifying electromagnetic waves or electromagnetic waves or a beam of particles, eg atoms, ions, molecules or charged particles, the apparatus comprising a micro or nano electrical conductor crossbar network having multiple cross-over junctions that define respective scattering points for electromagnetic waves or the particles of the beam. At least one structural parameter of the crossbar network is selectively tuneable to obtain a desired manipulation or modification of said wave or beam when incident on the network in a pre-determined directional electrical conductor crossbar network (10) configured as an atomic beam diffraction grating. The direction of wave propagation of the atomic beam is indicated by the arrow (15). The atomic beam is sufficiently slowed for it to exhibit wave behavior having a de Broglie wavelength of the order of magnitude of the lattice spacing of a lattice of scattering points (20) defined by crossbar network (10), and is thereby diffracted so as to form a diffraction pattern on downstream image plane (30). In this way, incident beam (15) is manipulated or modified by crossbar network (10) whereby the beam emerges from the network manipulated or modified with respect to incident beam (15).

36 Claims, 2 Drawing Sheets

OTHER PUBLICATIONS

Jian-Ping Y. et al., "Arrays of Microscopic Magnetic Traps For Cold Atoms and Their Applications In Atom Optics", Chinese Physics, (2002), pp. 472-480, vol. 11, No. 5.

R.J. Celotta, et al., "Nanostructure fabrication via laser focused atomic deposition", J. Appl. Phys., (1996), pp. 6079-6083, vol. 79, No. 8.

J.J. McClelland, et al., "Laser-Focused Atomic Deposition—Nanofabrication via Atomic Optics", National Institute of Standards and Technology, preprint.

J.J. McClelland, et al., "Nanofabrication via Atom Optics", in Handbook of Nanostructured Materials and Nanotechnology, (2000), pp. 335-385, vol. 1.

M.R. Walkiewicz, "Manipulation of Atoms Using Laser Light", The University of Melbourne Australia , (2000).

J.J. McClelland, et al., "Accuracy of Nanoscale Pitch Standards Fabricated by Laser-Focused Atomic Deposition", (2003), pp. 99-113, vol. 108, No. 2.

* cited by examiner

PARTICLE OPTICS AND WAVEGUIDE APPARATUS

FIELD OF THE INVENTION

This invention relates generally to the field of particle optics and waveguides, and in particular to devices for modifying or manipulating beams of particles and electromagnetic waves by influencing the wave properties of such beams. Particles of interest include atoms, ions molecules and charged particles such as electrons, and beam manipulations or modifications envisaged include modulation, tuning, diffraction, polarization and beam splitting. Applications of particular interest include electromagnetic waveguides and atom optics, the tunable diffraction-based spectroscopy of atoms, molecules and isotopes, gravimeters and related instrument, manipulation of electromagnetic waves, synchrotron optics, as well as non-lithographic deposition and patterning in the area of nanofabrication.

BACKGROUND ART

Atom optics relies on the concept of providing beams of atoms sufficiently slowed down for their de Broglie wavelengths to be of manageable nanometer-scale dimensions. An ongoing challenge is to develop suitable optics devices that will allow beams of atoms, or of ions or molecules or charged particles, to be usefully employed for their wave-like properties.

For example, interposition of an atomic lens can allow a beam of atoms from a diffuse source to be focused into an array of lines and dots of nanometer dimensions, a technique that can be applied as a novel form of nanofabrication. Such developments were described by R. J. Celotta, R. Gupta, R. E. Scholten and J. J. McClelland, in "Nanostructure fabrication via laser focused atomic deposition", J. Appl. Phys. 79 (80, 15 Apr. 1996a; J. J. McClelland and R. J Celotta, in "Laser-Focused Atomic Deposition—Nanofabrication via Atom Optics", pre-print, NIST; J. J. McClelland, "Nanofabrication via Atom Optics" in Handbook of Nanostructured Materials and Nanotechnology, Vol. 1, 335-385 (2000); M. R. Walkiewicz, "Manipulation of Atoms Using Laser Light", PhD Thesis, University of Melbourne, (2000) 222 p.' J. J, McClelland, William R. Anderson, Curtis C. Bradley, Mirek Walkiewicz, Robert J. Celotta, Erich Jurdik and Richard D. Deslattes, "Accuracy of nanoscale pitch standards fabricated by laser-focused atomic deposition" NIST Journal of Research 108(2), 99-113 (2003) Feb. 14, 2003. The NIST researchers used a laser light tuned near an atomic transition to form an array of atom lenses for focusing a beam of atoms into an array of dots of a size as small as 30 nanometers.

It is an object of this invention to provide a device useful in the field of electromagnetic waveguides and particle optics, and consequently in the manipulation of particle beams in the field of nanofabrication.

The invention borrows a structure known in another branch of nanotechnology and modifies and extends it for the purposes of the present invention. The known structure is the micro or nano electrical conductor crossbar network, previously described in a range of contexts including a displacement or vibration-measuring system (international patent publication WO 00/14476), a memory system (U.S. Pat. No. 6,128,214) and a demultiplexer (U.S. Pat. No. 6,256,767).

A micro or nano electrical conductor crossbar network comprises a set of two separate substrates, each having a two dimensional array of micro- or nano-wires (conductors) deposited on it and extending as an array of parallel lines on the substrates. The two substrates are separated by suitable distance. The arrays of parallel micro- or nano-conductors on the two substrates facing each other may be at an arbitrary angle with respect to each other, but of particular interest for some applications is the case where the arrays are at a right angle. Thus a crossbar network consists of a two dimensional array of micro or nanometer scale devices, each comprising a cross-over point or a junction formed where a pair of spaced conductors cross but do not touch one another. Each junction has a state, e.g. capacitance, or quantum tunnelling current conductance, that can be altered by applying a voltage across the respective conductors that cross at the junction.

The most significant feature of the aforementioned U.S. patents is the presence of a connector species forming an electron donor-bridge-acceptor (DBA) molecular junction (a molecular switch) at each cross-over, while international patent publication WO 00/14476 does not include a specific connector species, not even calls for them, but instead relies on a sensitivity to quantum tunnelling current at the cross-over points, and discloses how the set of cross-over points will form an artificial scattering lattice effective to scatter electromagnetic wave or a beam of atoms directed parallel to the sandwich structure into the space between the conductor layers. Each conductor may be independently connected electrically, i.e. they have no common bias; there will then be a pixelised array which is an analogue of a two-dimensional "pinball game" for waves or atoms, with predefined scattering centres. This concept is further developed in the present application and broadened to include larger dimensions.

Reference to the aforementioned patent publication and patents is not to be construed as an admission that their content, whether in whole or in part, is or has been common general knowledge.

SUMMARY OF THE INVENTION

The invention provides apparatus for manipulating or modifying electromagnetic waves or a beam of particles, eg atoms, ions, molecules or charged particles, which includes a micro or nano electrical conductor crossbar network having multiple cross-over junctions that define respective scattering points for the particles of the beam, wherein at least one structural parameter of the crossbar network is selectively tuneable to obtain a desired manipulation or modification of said beam when incident on the network in a pre-determined direction.

The invention also provides a method of manipulating or modifying electromagnetic waves or a beam of particles, eg atoms, ions, molecules or charged particles, including directing the beam as an incident beam into a micro or nano electrical conductor crossbar network in a predetermined direction, which network has multiple cross-over junctions that define respective scattering points for the particles of the beam and is arranged so that at least one structural parameter of the crossbar network is selectively tuneable to obtain a desired manipulation or modification of said beam, whereby the beam emerges from the network modified or manipulated with respect to the incident beam.

In the context of this specification, references to a micro or nano electrical conductor are an indication that the conductor has a width in the micron to nanometer range. The conductors may conveniently be flat strips or wires of any suitable cross-section, and may typically be supported on a substrate.

The method preferably includes, prior to directing the beam as described, tuning the crossbar network by tuning at least one structural parameter of the crossbar network with respect to the incident beam.

Advantageously, the conductors of the crossbar network have a width in the range 1 nanometer to 300 microns. Preferably, the conductors are arranged in respective spaced layers each having a subset of multiple substantially parallel conductors, eg on a respective substrate. The spacings between the conductors plus insulating strip (pitch) within each layer may be in the range 1 nanometer to 500 microns, while the spacing between layers is, eg, in the range 0.5 nanometers to 200 microns between opposed conductor faces.

The respective subsets of conductors can typically be supported in or on a respective insulating or semiconducting substrate.

In certain applications, the conductors can be carbon nanotubes of arbitrary helicity or radius, either single or multi-walled.

In one or more particular embodiments, there can be a connector species at some or all of the cross-over junctions in the crossbar network.

The separation of adjacent layers can be determined and defined in any suitable manner, in some cases dependent on the presence and nature of the connector species of the crossbar network. For example, the gap between substrates supporting respective conductor layers may be an at least partial vacuum or may be filled with an appropriate medium. Suitable arrangements for accurately maintaining the gap include the use of buckyball ($C_{60}$) nanobearings or nanotubes, or the interpositioning of a separation film of an organic medium, preferably organic liquid eg cyclohexane or soft matter spacer eg. Self Assembled Monolayers (SAMs).

The apparatus preferably includes means to selectively tune said at least one structural parameter of the network. More easily tuneable parameters include the angle between the alignments of parallel conductors in respective layers of the wires (tuned by relatively rotating the layers), the potential difference at each separate cross-over point (tuned by varying the potential applied to the individual conductors), or the actual configuration of scattering points defined by cross-over junctions in the network (tuned by altering the configuration of "live" conductors—see FIG. 2). Less easily tuneable parameter includes the spacing between adjacent layers of the conductors.

Selective turning of the tuneable parameter, where it is a spatial parameter, may be by mechanical adjustment means forming a nano or micro electromechanical system (NEMS or MEMS). For example, the adjustment means may include piezoelectric actuators of known type suitable for performing adjustments at nano- or micrometer scale dimensions.

Tuning can also be achieved by electrical and computer means, through pre-programmed tuning or real-time modification of variables eg conductor potentials.

In one application, the apparatus is a diffraction grating with respect to an incident particle beam, for splitting the incident particle beam into a plurality of parallel sub-beams, i.e. a diffraction pattern output.

It should be noted that for passing of charged particles through the grid, for fixed polarization i.e. constant voltage between the grids, charges will drift in the overall field and will be deflected from the plane of the two grids towards oppositely charged grid. To counter this so overall the charged particles cannot "feel" the polarization, the device can have oscillating potential; i.e. oscillating from positive to negative charge. The frequency of such oscillating applied potential of the electric field will depend on the dynamics of incoming beam of charged particles (mass, charge, velocity) and geometrical characteristics of the grid (spatial extension, separation between the lines, and separation between the planes).

BRIEF DESCRIPTION OF THE DRAWINGS

In order that the invention is more readily understood an embodiment will be described by reference to the drawings by way of illustration only wherein.

DESCRIPTION OF A PREFERRED EMBODIMENT OF THE INVENTION

Figure 1:
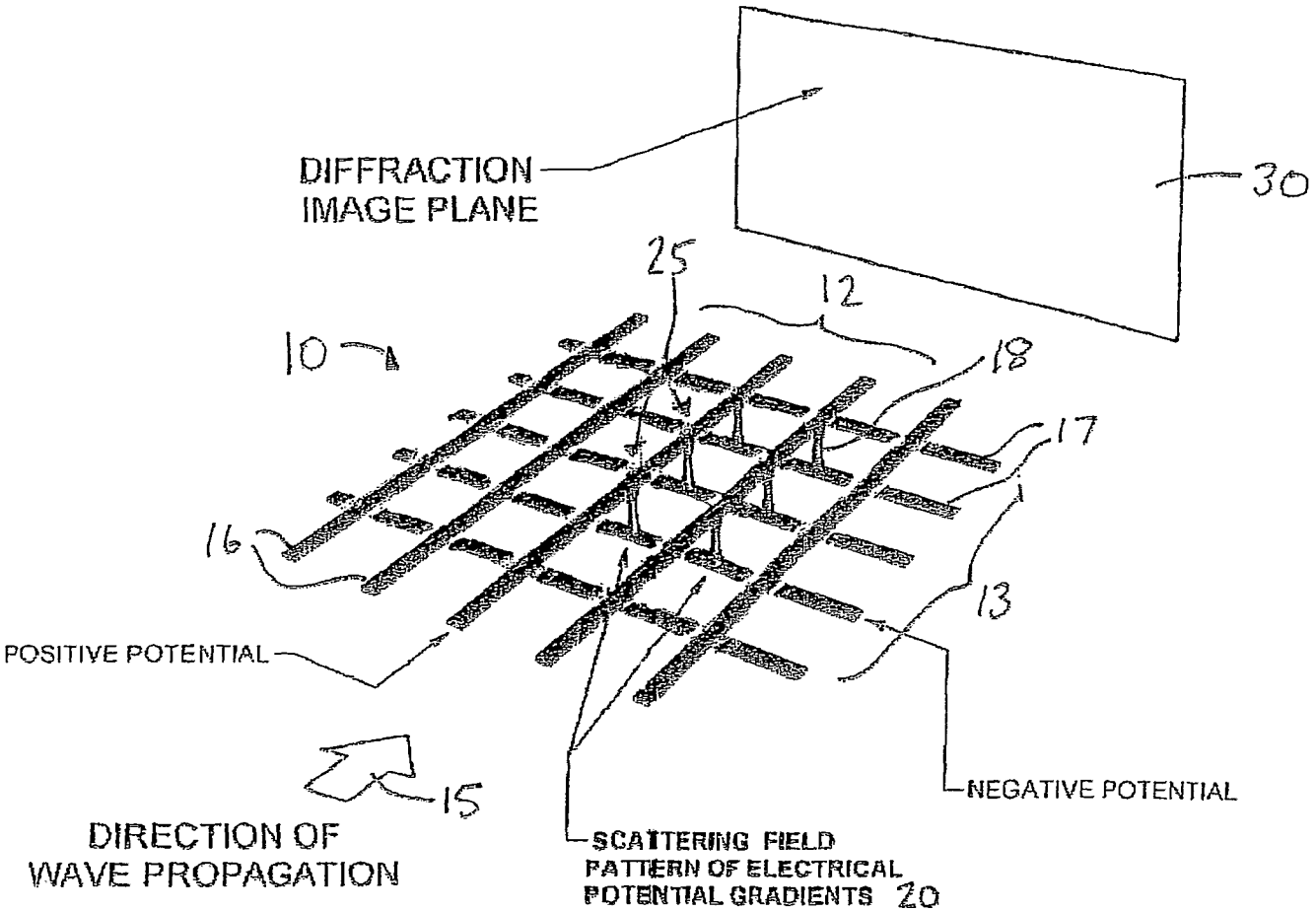
FIG. 1 is a diagrammatic view of an apparatus for manipulating or modifying electromagnetic waves or electromagnetic waves or a beam of particles in accordance with the invention.

Referring to the drawings there is shown an embodiment of the invention depicted in FIG. 1, which is a very simplified diagram of an electrical conductor crossbar network 10 configured as an atomic beam diffraction grating. The direction of wave propagation of the atomic beam is indicated by the arrow 15. The atomic beam is sufficiently slowed for it to exhibit wave behaviour having a de Broglie wavelength of the order of magnitude of the lattice spacing of a lattice of scattering points 20 defined by crossbar network 10, and is thereby diffracted so as to form a diffraction pattern on downstream image plane 30. In this way, incident beam 15 is manipulated or modified by crossbar network 10 whereby the beam emerges from the network manipulated or modified with respect to incident beam 15.

Crossbar network 10 comprises respective spaced layers 12, 13 of elongated electrical conductors 16, 17 typically provided in or on respective insulating or semiconductor substrates, not shown here for purposes of enhanced illustration.

There are a variety of techniques for forming crossbar network 10, well known and understood by those skilled in the art.

In each layer, the electrical conductors 16 and 17 are parallel, and the two conductor arrays extend at 90° with respect to each other so as to define multiple cross-overs or nodes 25. The nodes 25 thereby form cross-over junctions at which, when the pair of conductors are energised, the resultant electrical fields define scattering points 20 in a scattering field pattern of electrical potential gradients.

In a practical nanofabrication application, image plane 30 may be a substrate on which the atoms of beam 15 are being deposited in a pre-determined pattern constituting the diffraction pattern generated by the interaction between the atomic beam and the crossbar network. In a modification, a set of shutters may be placed perpendicularly between the crossbar network and the image plane (30) (which in turn can also be allowed to move in x and y directions).

Typically, each conductor 16, 17 has an independent electrical connection so that discrete electrical potentials can be applied individually to each conductor of each planar layer. This is a normal feature of crossbar networks. In this way, each node 25 can be separately characterised and the network can be tuned by varying the actual array of cross-over points that are "on" and therefore acting as scattering points. The lattice spacing parameter, or lattice constant, and the configuration of scattering points can thereby be varied and constitute tuneable parameters of network 10. An example is provided in the first configuration of FIG. 2 where, by switching off every second "horizontal" conductor, a rectangular lattice is formed from the square array of conductors. Moreover, the lattice form factor (or scattering "atomic factor") can be varied by altering the magnitude of the voltage bias at the crossover junctions.

Figure 2:
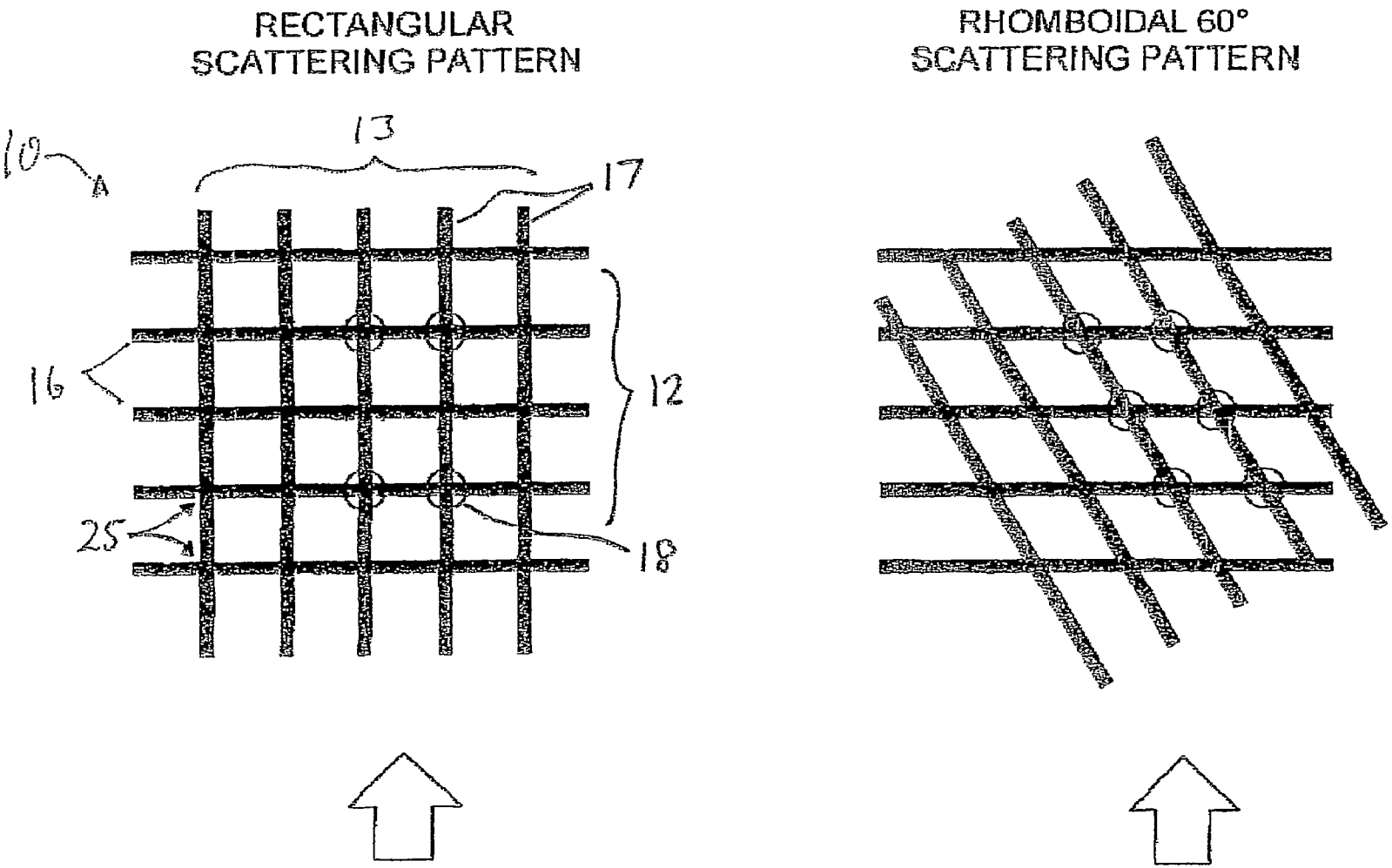
FIG. 2 comprises two different configurations of the apparatus of FIG. 1 to provide altered de Broglie scattering patterns.

If conductor layers 12, 13 are independently mounted in a structure that allows their respective substrates to be relatively moved towards or away from each other, or to be relatively rotated, respective physical parameters can be tuned to vary the scattering pattern in other ways. For example, in the second configuration of FIG. 2 shows how a square network or lattice can be converted to a rhomboidal network or lattice by simply rotating one substrate and therefore one planar conductor array over the other.

The spacing of the conductor layers 12, 13 is preferably in the range of 0.5 nanometers to 200 microns. If the spacing is less than approximately 10 to 15 nanometers, quantum tunnelling should dominate and will be observed at cross-over junctions or nodes 25, and will contribute to or constitute the mechanism by which the nodes become scattering points. At higher spacings, the cross-over points will form capacitances with a defined electrical field pattern.

Computational and numerical analysis of the parameter space for the illustrated device is capable of providing optimised solutions for particular applications. In particular, it is possible to numerically compute and respectively tune or modulate in real-time the geometrical 2-D structure of the device in terms of selected variable parameters from those discussed above, for optimal and desired performance.

Envisaged applications include, but are not limited to, nanofabrication and patterning using particle beams, atom writing and deposition, beamsplitters, spectroscopy of atoms, isotopes and molecules, gravimeters and several other instruments.

It will be understood that the invention disclosed and defined in this specification extends to all alternative combinations of two or more of the individual features mentioned or evident from the text or drawings.

The invention claimed is:

1. An apparatus for manipulating or modifying an electromagnetic wave or a beam of particles, the apparatus comprising:

a first layer of elongated electrical micro or nano conductors;

a second layer of elongated electrical micro or nano conductors spaced apart from the first layer and such that in a projection of the second layer into a plane of the first layer the apparatus has a network of projected cross-over junctions between the elongated conductors of the first and second layers;

the first and second layers are substantially parallel to a propagation direction of the electromagnetic wave or the beam of particles;

means for receiving respective electrical potentials in a tunable way to the micro or nano conductors of the first and second layers for inducing electrical mechanisms in areas between the first and second layers corresponding to the network of projected cross-over points such that scattering of the electromagnetic wave or the beam of particles occurs in said areas;

means for varying a relative disposition of the first and second layers of micro or nano conductors; and wherein the means for varying the relative disposition of the first and second layers is tunable for varying a scattering pattern of the apparatus, a form factor of the scattering, or both.

2. An apparatus according to claim 1, wherein the micro or nano conductors have a width in the range of about 1 nanometer to 300 microns.

3. An apparatus according to claim 1, wherein the first and second layers of micro or nano conductors each comprise a subset of multiple substantially parallel conductors.

4. An apparatus according to claim 3, wherein a spacings or pitch between the conductors within each layer is in the range of about 1 nanometer to 500 microns centre-to-centre, while a spacing between the first and second layers is in the range of about 0.5 nanometers to 200 microns between opposed conductor faces.

5. An apparatus according to claim 1, wherein the respective subsets of conductors are supported in or on respective insulating or semiconducting substrate.

6. An apparatus according to claim 1, wherein the conductors are carbon nanotubes of arbitrary helicity or radius, either single or multi-walled.

7. An apparatus according to claim 1, further comprising a connector species in some or all of said areas between the first and second layers corresponding to the network of projected cross-over junctions.

8. An apparatus according to claim 7, wherein the separation of adjacent layers is chosen dependent on the presence and nature of the connector species.

9. An apparatus according to claim 7, wherein a gap between substrates supporting the respective first and second layers is in at least a partial vacuum.

10. An apparatus according to claim 1, further comprising buckyball structures for controlling a gap between the first and second layers.

11. An apparatus according to claim 1, further comprising a separation film of an organic medium or a soft matter spacer interpositioned between the first and second layers for maintaining a gap between the first and second layers.

12. An apparatus according to claim 1, wherein the means for varying the disposition of the first and second layers tunes an angle between alignments of the micro or nano conductors in the respective layers by relatively rotating the first and second layers.

13. An apparatus according to claim 1, wherein the means for receiving the respective electrical potentials receives a tunable potential difference at said areas corresponding to the network of projected cross-over points by varying potentials applied to the individual conductors.

14. An apparatus according to claim 1, wherein the means for varying the disposition of the first and second layers tunes a spacing between the first and second layers.

15. An apparatus according to claim 1, wherein the means for varying the disposition of the first and second layers comprises a nano or micro electromechanical system (NEMS or MEMS).

16. An apparatus according to claim 1, wherein the apparatus functions as a diffraction grating with respect to the electromagnetic wave or the beam of particles for splitting the incident electromagnetic wave or beam of particles.

17. An apparatus according to claim 1, wherein the means for receiving the respective electrical potentials receives oscillating potentials to the micro or nano conductors of the first and second layers, oscillating from positive to negative charge.

18. An apparatus according to claim 17, wherein a frequency of the oscillating potentials is chosen based on characteristics of a beam of charged particles to be manipulated or modified and based on geometrical characteristics of the scattering pattern.

19. A method for manipulating or modifying an electromagnetic wave or a beam of particles, the method comprising the steps of:

providing a first layer of elongated electrical micro or nano conductors;

providing a second layer of elongated electrical micro or nano conductors spaced apart from the first layer and such that in a projection of the second layer into a plane of the first layer the apparatus has a network of projected cross-over junctions between the elongated conductors of the first and second layers;

wherein the first and second layers are substantially parallel to a propagation direction of the electromagnetic wave or the beam of particles; and applying respective electrical potentials to the micro or nano conductors of the first and second layers for inducing electrical mechanisms in areas between the first and second layers corresponding to the network of projected cross-over points such that scattering of the electromagnetic wave or the beam of particles occurs in said areas;

varying a relative disposition of the first and second layers of micro or nano conductors; and tuning the applying of the respective electrical potentials and the varying of the relative disposition of the first and second layers for varying a scattering pattern of the apparatus, a form factor of the scattering, or both.

20. An apparatus according to claim 19, wherein the micro or nano conductors have a width in the range of about 1 nanometer to 4400 microns.

21. An apparatus according to claim 19, wherein the first and second layers of micro or nano conductors each comprise a subset of multiple substantially parallel conductors.

22. An apparatus according to claim 21, wherein a spacings spacing or pitch between the conductors within each layer is in the range of about 1 nanometer to 500 microns centre-to-centre, while a spacing between the first and second layers is in the range of about 0.5 nanometer to 200 microns between opposed conductor faces.

23. An apparatus according to claim 19, wherein the respective subsets of conductors are supported in or on respective insulating or semiconducting substrate.

24. An apparatus according to claim 19, wherein the conductors are carbon nanotubes of arbitrary helicity or radius, either single or multi-walled.

25. An apparatus according to claim 19, further comprising providing a connector species in some or all of said areas between the first and second layers corresponding to the network of projected cross-over junctions.

26. An apparatus according to claim 25, wherein the separation of adjacent layers is chosen dependent on the presence and nature of the connector species.

27. An apparatus according to claim 25, wherein a gap between substrates supporting the respective first and second layers is in at least a partial vacuum.

28. An apparatus according to claim 19, further comprising providing buckyball structures for controlling a gap between the first and second layers.

29. An apparatus according to claim 19, further comprising providing a separation film of an organic medium or a soft matter spacer interpositioned between the first and second layers for maintaining a gap between the first and second layers.

30. An apparatus according to claim 19, wherein the varying of the disposition of the first and second layers comprises tuning an angle between alignments of the micro or nano conductors in the respective layers by relatively rotating the first and second layers.

31. An apparatus according to claim 19, wherein the applying of the respective electrical potentials comprises tuning a potential difference at said areas corresponding to the network of projected cross-over points by varying potentials applied to the individual conductors.

32. An apparatus according to claim 19, wherein the varying of the disposition of the first and second layers comprises tuning a spacing between the first and second layers.

33. An apparatus according to claim 19, wherein the varying of the disposition of the first and second layers comprises utilizing a nano or micro electromechanical system (NEMS or MEMS).

34. An apparatus according to claim 19, wherein the scattering pattern functions as a diffraction grating with respect to the electromagnetic wave or the beam of particles for splitting the incident electromagnetic wave or beam of particles.

35. An apparatus according to claim 19, wherein the applying of the respective electrical potentials comprises applying oscillating potentials to the micro or nano conductors of the first and second layers, oscillating from positive to negative charge.

36. An apparatus according to claim 35, wherein a frequency of the oscillating potentials is chosen based on characteristics of a beam of charged particles to be manipulated or modified and based on geometrical characteristics of the scattering pattern.

* * * * *